US010889470B2

(12) United States Patent
Duvall

(10) Patent No.: US 10,889,470 B2
(45) Date of Patent: Jan. 12, 2021

(54) AUTOMATIC ROPE TENSION EQUALIZER SYSTEM AND METHOD

(71) Applicant: THYSSENKRUPP ELEVATOR CORPORATION, Alpharetta, GA (US)

(72) Inventor: Jeffrey Duvall, Woodstock, GA (US)

(73) Assignee: thyssenkrupp Elevator Corporation, Alpharetta, GA (US)

( * ) Notice: Subject to any disclaimer, the term of this patent is extended or adjusted under 35 U.S.C. 154(b) by 462 days.

(21) Appl. No.: 15/836,317

(22) Filed: Dec. 8, 2017

(65) Prior Publication Data

US 2019/0177127 A1 Jun. 13, 2019

(51) Int. Cl.

| | |
|---|---|
| ***B66B 7/10*** | (2006.01) |
| ***B66B 5/12*** | (2006.01) |
| ***B66B 1/04*** | (2006.01) |

(52) U.S. Cl.

CPC ..... *B66B 7/10* (2013.01); *B66B 1/04* (2013.01); *B66B 5/12* (2013.01)

(58) Field of Classification Search

CPC ..... B66B 5/12; B66B 7/10
See application file for complete search history.

(56) References Cited

U.S. PATENT DOCUMENTS

| | | | | |
|---|---|---|---|---|
| 1,323,357 | A * | 12/1919 | Evans | B66B 7/10 187/370 |
| 1,516,727 | A * | 11/1924 | Hawkins | B66B 7/10 187/412 |
| 1,632,083 | A | 6/1927 | Kieckhefer | |
| 1,991,538 | A * | 2/1935 | Beatty | B66B 7/10 187/412 |
| 2,001,007 | A * | 5/1935 | Wilson | B66B 7/10 187/412 |
| 3,052,320 | A | 9/1962 | Dardy | |
| 6,223,862 | B1 * | 5/2001 | Barnes | B66B 7/06 187/412 |
| 8,162,110 | B2 | 4/2012 | Smith et al. | |
| 2004/0154876 | A1 | 8/2004 | Choi | |
| 2019/0119070 | A1 * | 4/2019 | Kang | B66B 9/00 |

FOREIGN PATENT DOCUMENTS

| | | | | |
|---|---|---|---|---|
| DE | 699728 C | * | 12/1940 | B66B 7/10 |
| DE | 1171130 B | * | 5/1964 | B66B 7/10 |
| DE | 1171130 B | | 5/1964 | |
| SU | 772966 A1 | | 10/1980 | |
| WO | WO-2018109881 A1 | * | 6/2018 | B66B 7/06 |

* cited by examiner

*Primary Examiner* — Diem M Tran
(74) *Attorney, Agent, or Firm* — William J Cassin

(57) ABSTRACT

An automatic rope tension equalizer system includes first, second, and third plungers, first, second, and third cam assemblies, and a hitch plate with first, second, and third cavities. The first, second, and third plungers are at least partially situated in the first, second, and third cavities, respectively. Each cam assembly has a cam and a rod extending therefrom. The cam of the first cam assembly engages the first plunger, the cam of the second cam assembly engages the second plunger, and the cam of the third cam assembly engages the third plunger. A network connects each cavity to each other cavity, and fluid in the network automatically equalizes pressure on the first, second, and third plungers, thereby affecting positioning of the first, second, and third plungers and, through each cam, tension on each rod.

18 Claims, 8 Drawing Sheets

AUTOMATIC ROPE TENSION EQUALIZER SYSTEM AND METHOD

BACKGROUND

Embodiments of the present disclosure relate, in general, to an apparatus for automatically equalizing uneven tension of ropes of a system where load countermeasures are needed, such as elevators, lifts, cranes, dumbwaiters, boat lifts, and suspension bridges.

When a system, such as an elevator having a plurality of ropes for supporting a load, is used over time, each of the plurality of ropes have their own individual service life. This may be caused by the ropes having different expansion rates, different lengths causing different tensions, misalignment of equipment, improper installation of equipment, a fault of a sheave material or rope material, uneven wearing of sheave grooves, an eccentric load applied, and/or any combinations thereof. For instance, if a length difference exists between the ropes of an elevator system, the ropes may be subject to uneven tension because the load is unevenly applied to the ropes. Due to a variation in length among ropes, the rope having relatively short length when compared to the others may be subject to over-tension such that the wires of those ropes are more rapidly worn. In practice, when one rope has reached its maximum load capacity, all ropes in the system are replaced and not just a single rope. This leads to unnecessary expense and waste. Furthermore, when the ropes are initially established or when the ropes are exchanged, it is difficult to precisely match the lengths of the ropes with each other due to a bending structure and rigidity of the wire ropes, so the length difference of the ropes occurs again and the cycle repeats.

A typical elevator system includes an elevator car and counterweight suspended by a tension member within a hoistway. Terminations are fixed to the end of the tension member, which are in turn attached to a structure such as a mounting plate or beam that is fixed relative to the hoistway. A load cell is fixed between a spring and a mounting plate such that the load cell measures the weight borne by the tension member. For elevators having multiple tension members, there may be a load cell for each tension member. The total load of the elevator car is then measured by adding each of the loads measured at each of the plurality of tension members.

Therefore, it may be advantageous to provide an automatic rope tension equalizing system for an elevator system having a plurality of ropes that compensates for the tension in each rope to equalize the tension of all ropes. It may also be advantageous to provide such an elevator load measurement system that works in real time. Furthermore, it may be desirable for such a system to dampen any vibration energy in the ropes.

SUMMARY

The following presents a simplified summary of the disclosure in order to provide a basic understanding of some aspects of the disclosure. This summary is not an extensive overview of the disclosure. It is not intended to identify critical elements of the disclosure or to delineate the scope of the disclosure. Its sole purpose is to present some concepts of the disclosure in a simplified form as a prelude to the more detailed description that is presented elsewhere.

Novel and unobvious rope tension equalizers and systems having such devices are set forth herein, as will be evident from reviewing the description below and the accompanying drawings.

According to one embodiment, an automatic rope tension equalizer system has a hitch plate, first and second plungers, and first and second cam assemblies. The hitch plate has first and second apertures, and each aperture having a cavity. The first plunger is at least partially situated in the cavity of the first aperture, and the second plunger is at least partially situated in the cavity of the second aperture. The first and second cam assemblies are respectively positioned at least partially within the first and second apertures. Each cam assembly has a cam and a rod extending therefrom. The cam of the first cam assembly engages the first plunger, and the cam of the second cam assembly engages the second plunger. A network connects each cavity to each other cavity, and fluid in the network automatically equalizes pressure on the first and second plungers, thereby affecting positioning of the first and second plungers and, through each cam, tension on each rod.

In an embodiment, the fluid is a hydraulic fluid.

In an embodiment, the fluid is a pneumatic gas.

In an embodiment, each plunger has a rotational interfacing member contacting a respective cam.

In an embodiment, the rotational interfacing member of the first plunger rotates about a single axis.

In an embodiment, the rotational interfacing member of the first plunger rotates in a ball and socket arrangement.

In an embodiment, each rod is integrated with or permanently connected to a rope.

In an embodiment, excess tension on the rod of the first cam assembly causes, via interaction between the cam of the first cam assembly and the first plunger, the first plunger to further enter the cavity of the first aperture.

In an embodiment, the first plunger further entering the cavity of the first aperture displaces the fluid in the network, causing the second plunger to further exit the cavity of the second aperture, thereby causing, via interaction between the cam of the second cam assembly and the second plunger, tension to increase on the rod of the second cam assembly.

In an embodiment, the cam of the first cam assembly is adjacent a cam retainer plate. And the rod of the first cam assembly passes through a hole in the cam retainer plate.

In an embodiment, the rod of the first cam assembly has a first coupling member engaging a first rope, and the rod of the second cam assembly has a second coupling member engaging a second rope.

In an embodiment, the first and second ropes support an elevator car.

In an embodiment, the first and second ropes support an elevator car and a counterweight.

In an embodiment, the cam of the first cam assembly has a face engaging the first plunger. The face has a conical, planar, concave, or convex shape.

In an embodiment, the rod of the first cam assembly extends perpendicularly to a direction of travel of the first plunger.

In an embodiment, the hitch plate further includes a third aperture having a cavity, and a third plunger is at least partially situated in the cavity of the third aperture. A third cam assembly is positioned at least partially within the third aperture, and the third cam assembly has a cam and a rod extending therefrom. The cam of the third cam assembly engages the third plunger. The fluid in the network automatically equalizes pressure on the first, second, and third plungers, thereby affecting positioning of the first, second, and third plungers and, through each cam, tension on each rod.

In an embodiment, the cam of the first cam assembly is positioned between a roller and the first plunger.

According to another embodiment, an automatic rope tension equalizer system includes a hitch plate, first, second, and third plungers, and first, second, and third cam assemblies. The hitch plate has first, second, and third cavities. The first plunger is at least partially situated in the first cavity, the second plunger is at least partially situated in the second cavity, and the third plunger is at least partially situated in the third cavity. Each cam assembly has a cam and a rod extending therefrom. The cam of the first cam assembly engages the first plunger, the cam of the second cam assembly engages the second plunger, and the cam of the third cam assembly engages the third plunger. A network connects each cavity to each other cavity, and fluid in the network automatically equalizes pressure on the first, second, and third plungers, thereby affecting positioning of the first, second, and third plungers and, through each cam, tension on each rod.

In an embodiment, the rod of the first cam assembly has a first coupling member engaging a first rope, the rod of the second cam assembly has a second coupling member engaging a second rope, and the rod of the third cam assembly has a third coupling member engaging a third rope. The first, second, and third ropes support an elevator car.

In an embodiment, excess tension on the rod of the first cam assembly causes, via interaction between the cam of the first cam assembly and the first plunger, the first plunger to further enter the first cavity. The first plunger further entering the first cavity displaces the fluid in the network, causing the second plunger to further exit the second cavity and the third plunger to further exit the third cavity. The second plunger further exiting the second cavity causes, via interaction between the cam of the second cam assembly and the second plunger, tension to increase on the rod of the second cam assembly. The third plunger further exiting the third cavity causes, via interaction between the cam of the third cam assembly and the third plunger, tension to increase on the rod of the third cam assembly.

According to yet another embodiment, an elevator system includes an elevator car, a first rope supporting the elevator car, a second rope supporting the elevator car, a hitch plate having a first cavity and a second cavity, a first plunger at least partially situated in the first cavity, a second plunger at least partially situated in the second cavity, and first and second cam assemblies. Each cam assembly has a cam and a rod extending therefrom. The cam of the first cam assembly engages the first plunger, the cam of the second cam assembly engages the second plunger, the rod of the first cam assembly has a first coupling member engaging the first rope, and the rod of the second cam assembly has a second coupling member engaging the second rope. A network connects each cavity to each other cavity, and fluid in the network automatically equalizes pressure on the first and second plungers, thereby affecting positioning of the first and second plungers and, through each cam, tension on each rod.

In an embodiment, excess tension on the rod of the first cam assembly causes, via interaction between the cam of the first cam assembly and the first plunger, the first plunger to further enter the first cavity. And excess tension on the rod of the second cam assembly causes, via interaction between the cam of the second cam assembly and the second plunger, the second plunger to further enter the second cavity. The first plunger further entering the first cavity displaces the fluid in the network, causing the second plunger to further exit the second cavity, thereby causing, via interaction between the cam of the second cam assembly and the second plunger, tension to increase on the rod of the second cam assembly. The second plunger further entering the second cavity displaces the fluid in the network, causing the first plunger to further exit the first cavity, thereby causing, via interaction between the cam of the first cam assembly and the first plunger, tension to increase on the rod of the first cam assembly.

DETAILED DESCRIPTION

Figure 1:
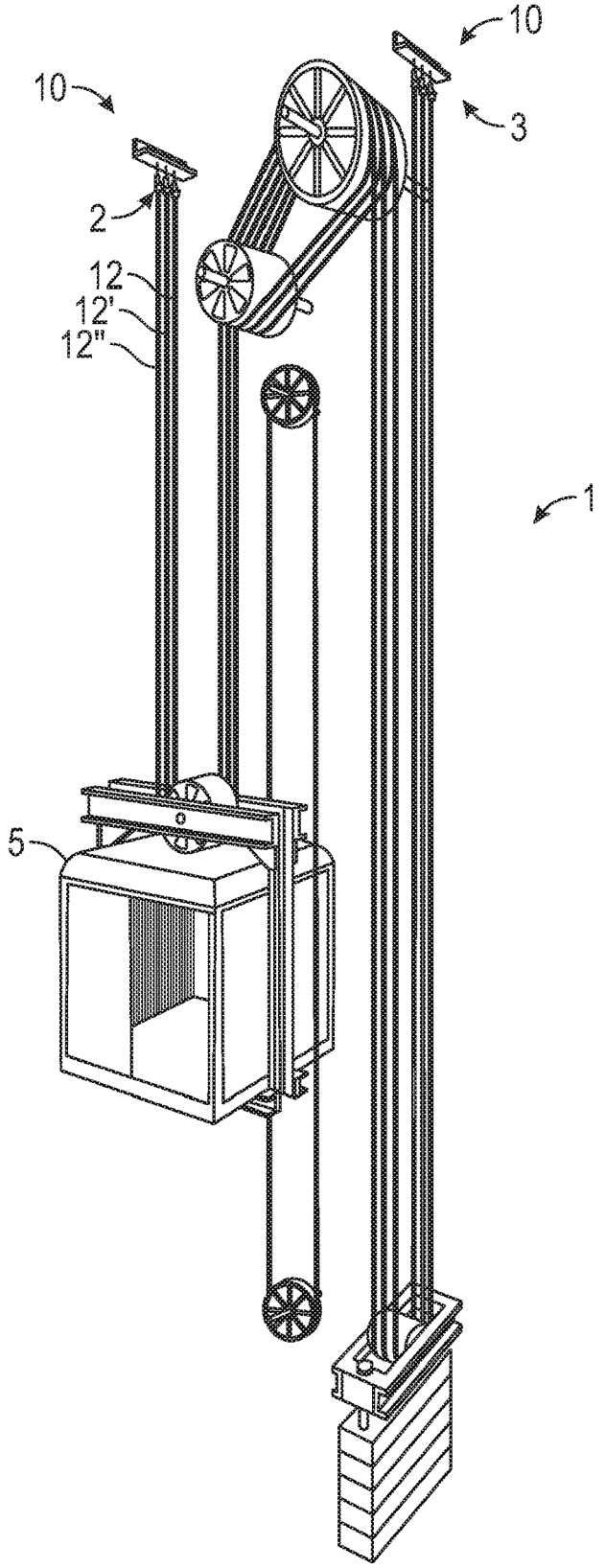
FIG. 1 is a perspective view of an elevator system having an automatic rope tension equalizing system according to the present disclosure.

FIGS. 1 through 8 illustrate a rope tension equalizer system 10 adapted to support at least two ropes or tensionable members. In the illustrated embodiment, there are three ropes 12, 12', 12". Referring to FIG. 1, an elevator system 1 has a respective rope tension equalizer system 10 located at each terminal end 2, 3 of the elevator system 1. As used herein, the term "rope" refers to any tension member suitable for use in the disclosed elevator system and apparatus, including but not limited to a rope, belt, cable, chain, or other tension member or suspension means. Each rope 12, 12', 12" has a tension. In one embodiment of the present disclosure, an elevator car 5 and a counterweight is supported by the plurality of ropes 12, 12', 12", with each rope 12, 12', 12" automatically tensioned equally while the car 5 and counterweight are moving or at rest.

Figure 2:
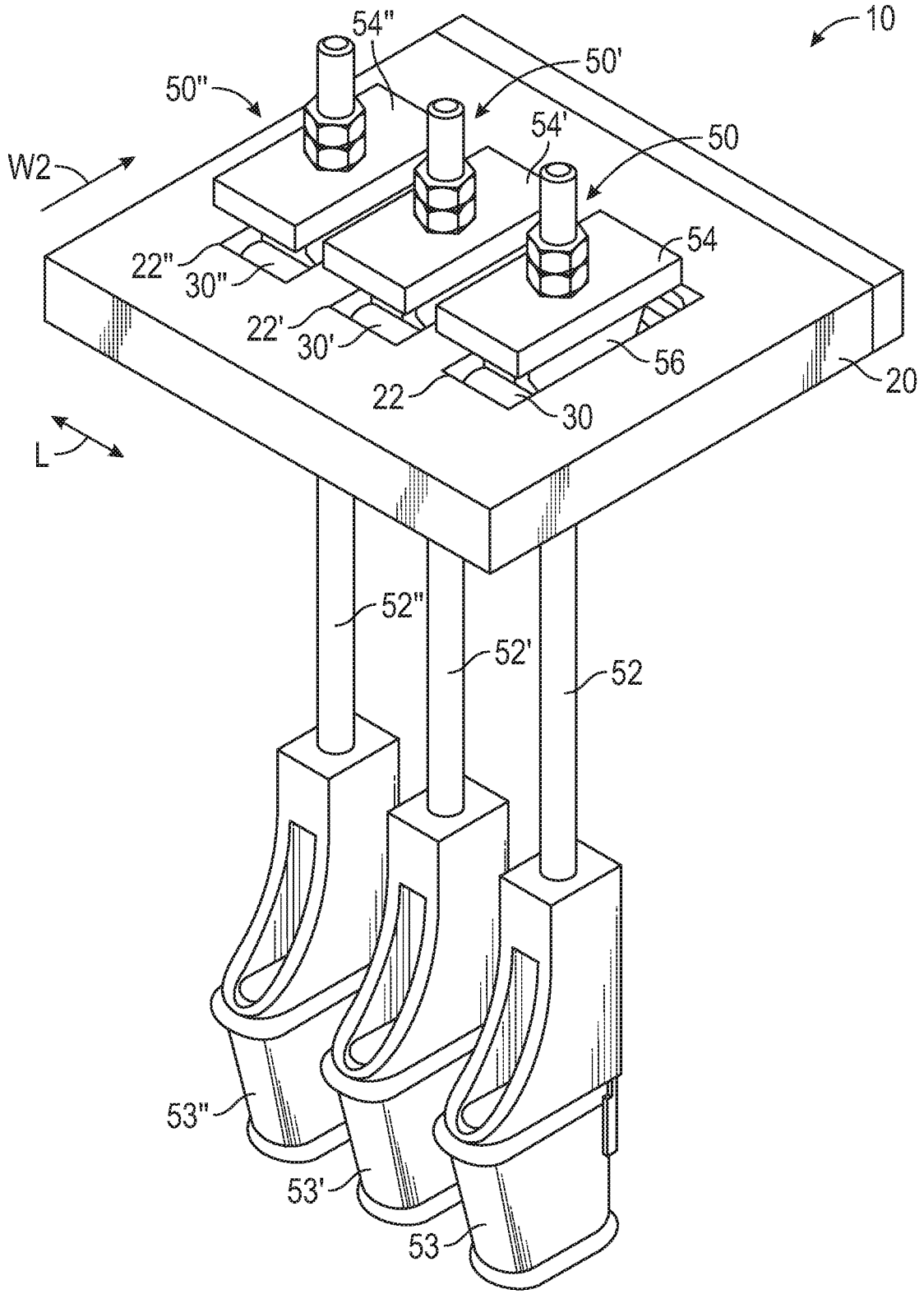
FIG. 2 is a perspective view of the automatic rope tension equalizing system of FIG. 1.
Figure 3:
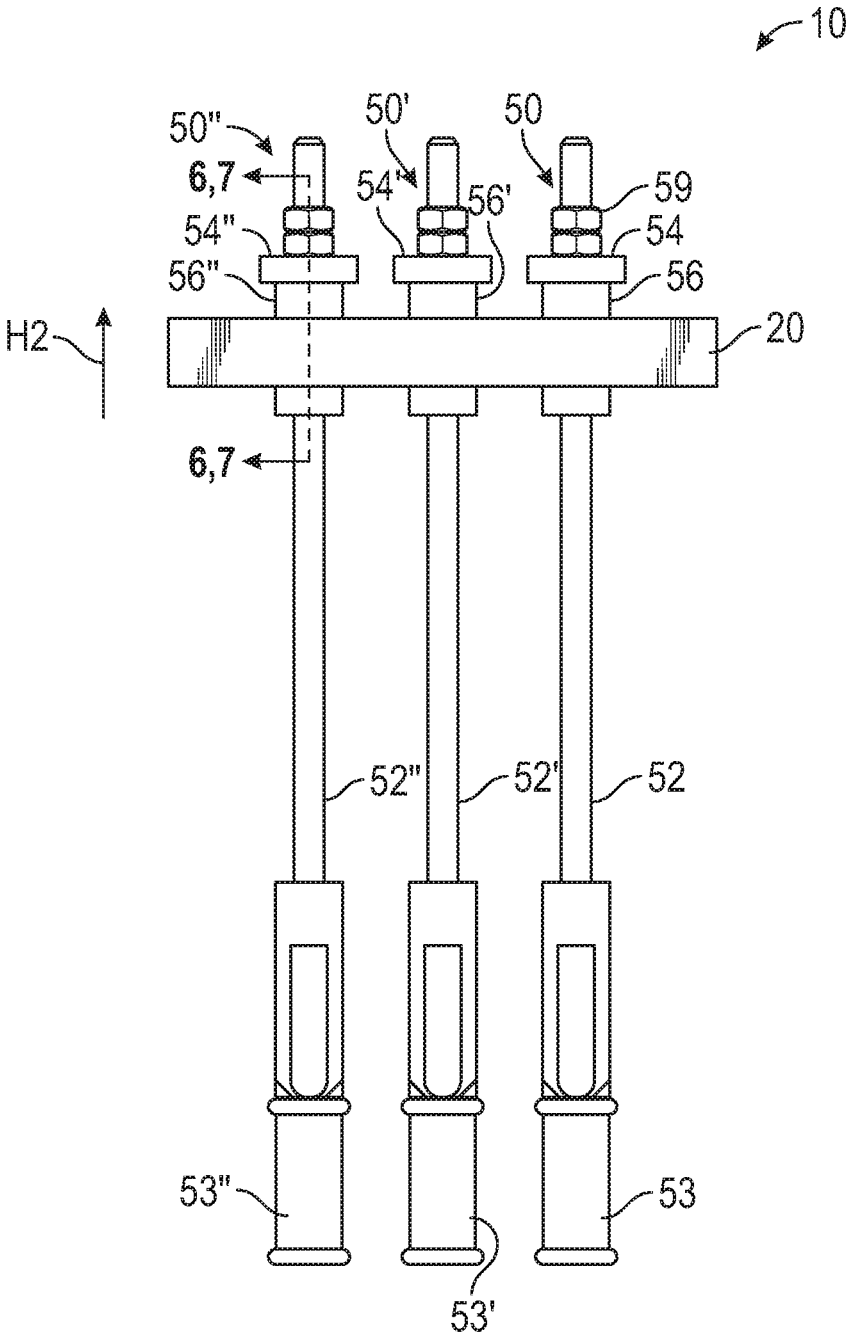
FIG. 3 is a front view of the automatic rope tension equalizing system of FIG. 1.
Figure 4:
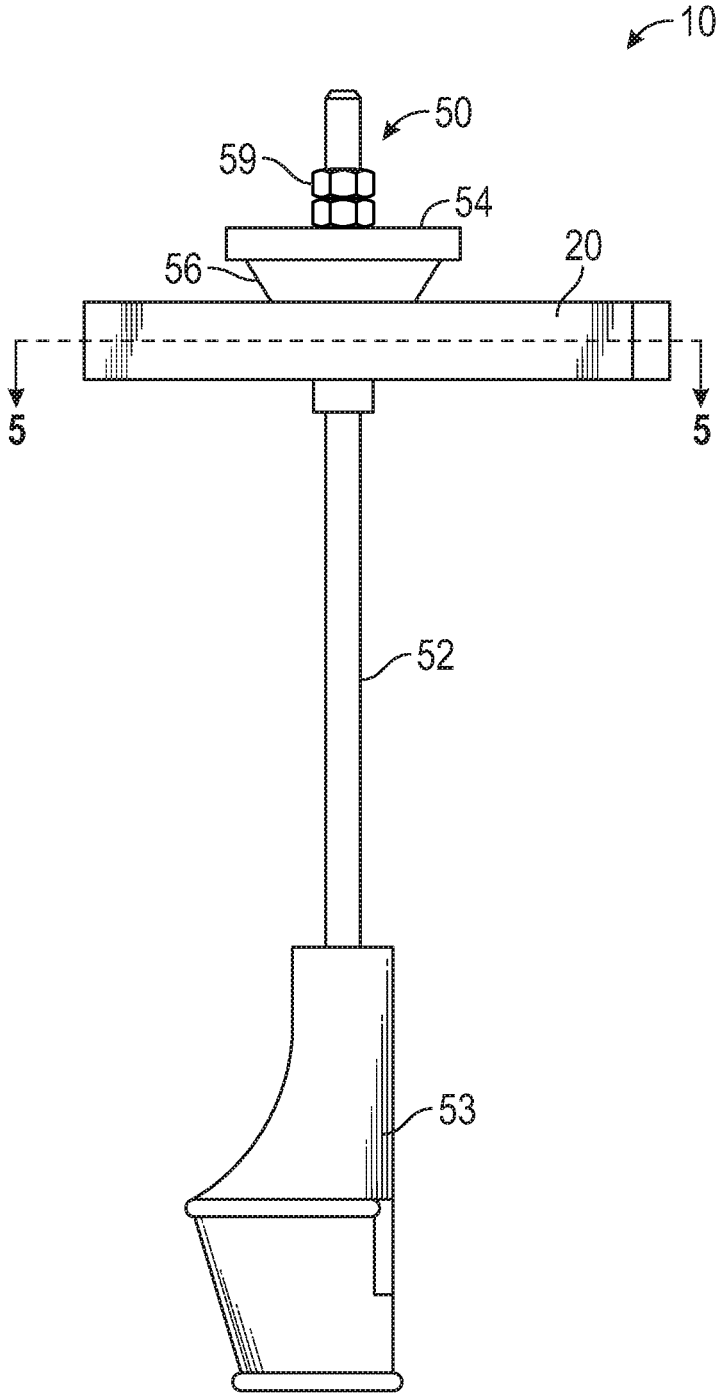
FIG. 4 is a side view of the automatic rope tension equalizing system of FIG. 1.
Figure 5:
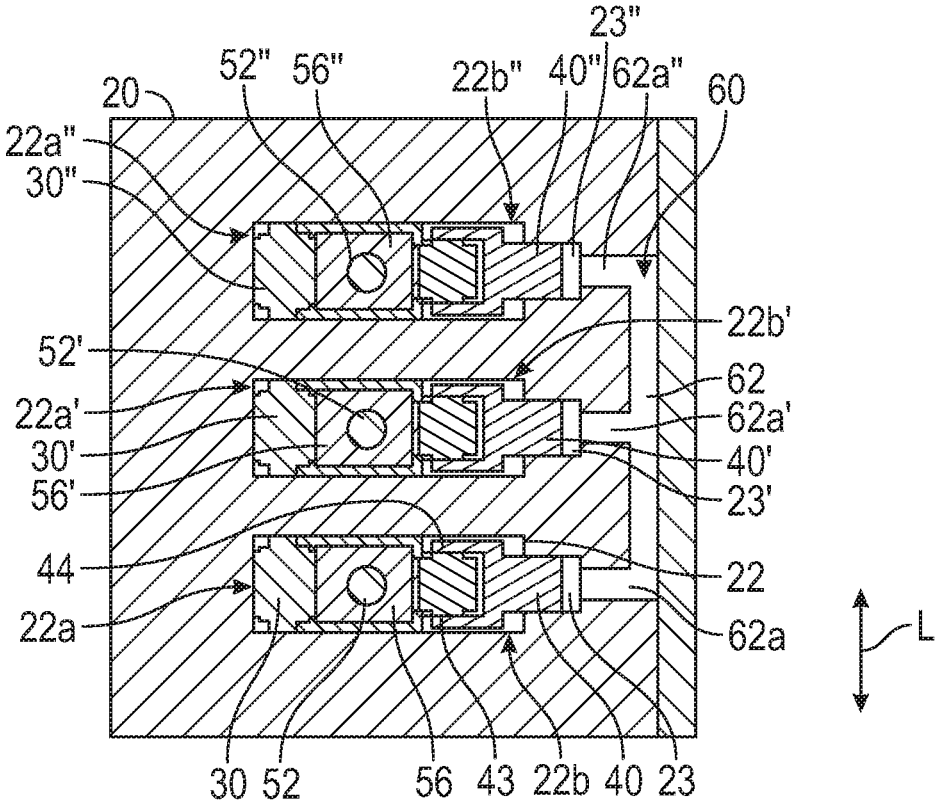
FIG. 5 is a cross section view taken along line 5-5 in FIG. 4.

Referring to FIGS. 2 through 5, the rope tension equalizer system 10 may include a hitch plate 20, stationary rollers 30, 30', 30" (FIGS. 2 and 5), plungers 40, 40', 40" (FIG. 5), and cam assemblies 50, 50', 50" respectively having a shackle rod 52, 52', 52" (FIG. 3), a cam retainer plate 54, 54', 54", and a cam 56, 56', 56" (FIG. 3). The hitch plate 20 is a support structure and may be any appropriate geometric shape. The illustrated hitch plate 20 includes three apertures 22, 22', 22" which are shown to be generally rectangular, but may also be any appropriate geometric shape. As shown in FIG. 5, each aperture 22, 22', 22" has opposed ends 22*a*, 22*a'*, 22*a"* and 22*b*, 22*b'*, 22*b"*, and the rollers 30, 30', 30" are situated at one end 22*a*, 22*a'*, 22*a"* while the plungers 40, 40', 40" are at the other end 22*b*, 22*b*', 22*b*". An axis of each roller 30, 30', 30" extends generally in direction L (FIG. 2), and the respective cams 56, 56', 56" are between the rollers 30, 30', 30" and the plungers 40, 40', 40".

The ropes 12, 12', 12" (FIG. 1) may be removably coupled to the shackle rods 52, 52', 52", such as through coupling members 53, 53', 53" (FIG. 2). Alternately, the shackle rods 52, 52', 52" may be integrated with the ropes 12, 12', 12" or permanently connected to the ropes 12, 12', 12' such that the coupling member 53, 53', 53" are omitted. Integration may be accomplished, for example, with adhesives, welding, or by manipulating individual wires of ropes 12, 12', 12". But especially in applications (including in elevator systems) where ropes are regularly replaced, it may be particularly desirable for coupling members 53, 53', 53" to be included to facilitate replacing the ropes. The coupling members 53, 53', 53" may be welded to the shackle rods 52, 52', 52" or otherwise coupled thereto in any appropriate manner.

Figure 6:
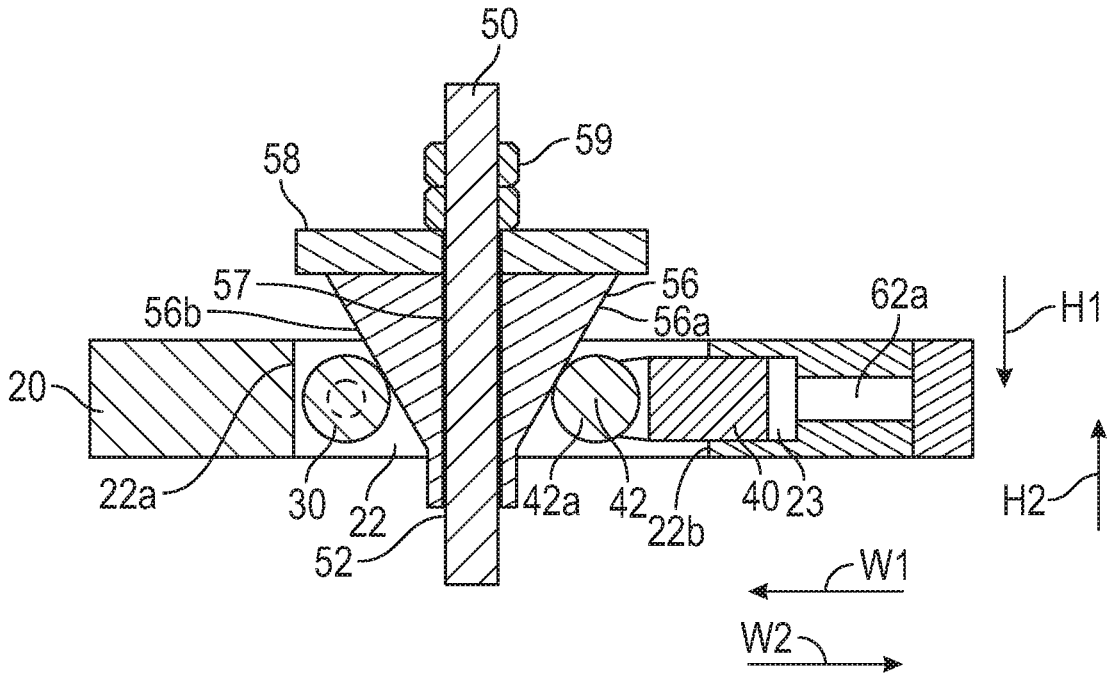
FIG. 6 is a cross section view taken along line 6,7-6,7 in FIG. 3, with the automatic rope tension equalizing system being in a first configuration.
Figure 7:
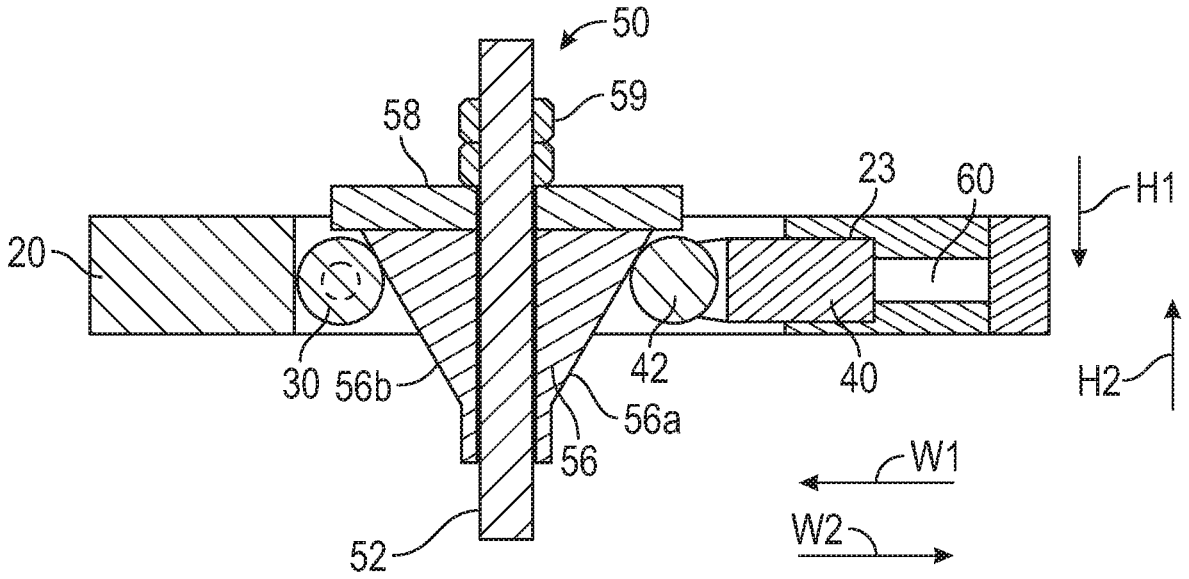
FIG. 7 is a cross section view taken along line 6,7-6,7 in FIG. 3, with the automatic rope tension equalizing system being in a second configuration.

FIGS. 6 and 7 illustrate one portion of the system 10, and specifically structure which ultimately adjusts the tension on rope 12. Corresponding (and cooperating) structure is used to adjust the tension on ropes 12' and 12". For example, the rollers 30, 30', 30", plungers 40, 40', 40", and cam assemblies 50, 50', 50" may all be arranged in the same functional manner.

The shackle rod 52 is shown passing through an aperture 57 in a center axis of the cam 56 (which is generally perpendicular to the directions L, W1, W2), and is coupled to the cam 56 by at least one nut 59 or other fastener (e.g., pins, welding, et cetera). A cam retaining plate 58 is illustrated between the cam 56 and the nut 59, though in some embodiments the plate 58 may be unitary with the cam 56 or omitted. The geometry of the cam retaining plate 58 prevents the cam assemblies 50, 50', 50" from being able to fall through the hitch plate 20 in the event of catastrophic fluid or gas loss from a reservoir (which includes, for example, channels 62, network 60, and at least a portion of chambers 23, with each being defined in additional detail below). The cam 56 may separate opposite ends the shackle rod 52, such that the fastener 59 (FIG. 6) is on one end of the cam 56 and the coupling member 53 (FIG. 2) is on another end of the cam 56. The cam 56 has one face 56*a* engaging the plunger 40 and another face 56*b* engaging the roller 30. The faces 56*a*, 56*b* may for example be distinct planar, concave, or convex surfaces, or a unitary conical surface. In some embodiments, the faces 56*a*, 56*b* of a given cam 56 may have the same slope, and in alternate embodiments, one face 56*a* may be a vertical face, or run parallel to the direction of tension in the rope or shackle rod 52, while the other face 56*a* is sloped with respect to the direction of tension in the rope or shackle rod 52. In still additional alternate embodiments, the faces 56*a*, 56*b* may have different slopes with respect to the direction of tension in the rope or shackle rod 52, as needed.

The plunger 40 is seated in chamber (or "cavity") 23 of the aperture end 22*b* and is movable in directions W1 and W2, which are generally transverse to the direction L. The interaction between the plunger 40 and the plate 20 at the chamber 23 is sufficiently sealed such that fluid or gas in the chamber 23 does not escape, and gaskets may be used as necessary or desired. An interfacing member 42 (preferably a rotational member 42*a*, though in some embodiments a non-rotating member) is located at an end of the plunger 40 that is closest to the cam 56. The rotational member 42*a* may be captured between a first side arm 43 and a second side arm 44 (FIG. 5), or otherwise appropriately attached, such as through a ball-and-socket joint. If non-rotating, the interfacing member 42 may be coupled to a body of the plunger 40 or simply defined by an end of the plunger 40. As described in more detail below, the interfacing member 42 engages the cam 56 at the face 56*a*.

A network 60 connects the chamber 23 to a chamber 23' of the end 22*b*' and to a chamber 23" of the end 22*b*", such that the chambers 23, 23', 23" are effectively in parallel to one another (instead of a serial arrangement). Fluid (i.e., hydraulic fluid or gas) is situated within the network 60, and the network 60 more particularly includes a channel 62 and branch lines 62*a*, 62*a*', 62*a*" connecting the chambers 23, 23' 23".

Each plunger 40, 40', 40" has three basic states (or positions) that correspond to states of the associated ropes 12, 12', 12": an over-tensioned state, an under-tensioned state, and an equalized state. When at least one of the plungers 40, 40', 40" is at an over-tensioned position, at least one of the other plungers 40, 40', 40" is at an under-tensioned position; and when at least one of the plungers 40, 40', 40" is at an under-tensioned position, at least one of the other plungers 40, 40', 40" is at an over-tensioned position. Ideally, all of the plungers 40, 40', 40" are at the equalized state. When at the over-tensioned state, the respective plunger 40, 40', 40" has entered into the respective cavity 23, 23', 23" further than if at the under-tensioned or equalized state; and when at the under-tensioned state, the respective plunger 40, 40', 40" has exited the respective cavity 23, 23', 23" further than if at the over-tensioned or equalized state. In practice, the fluid in the network 60 automatically equalizes the pressure on the plungers 40, 40', 40", affecting the positioning of the plungers 40, 40', 40", and in turn (through interaction between the plungers 40, 40', 40" and the cams 56, 56', 56") affects positioning of the rods 52, 52', 52" and tension on the ropes 12, 12', 12".

Figure 8:
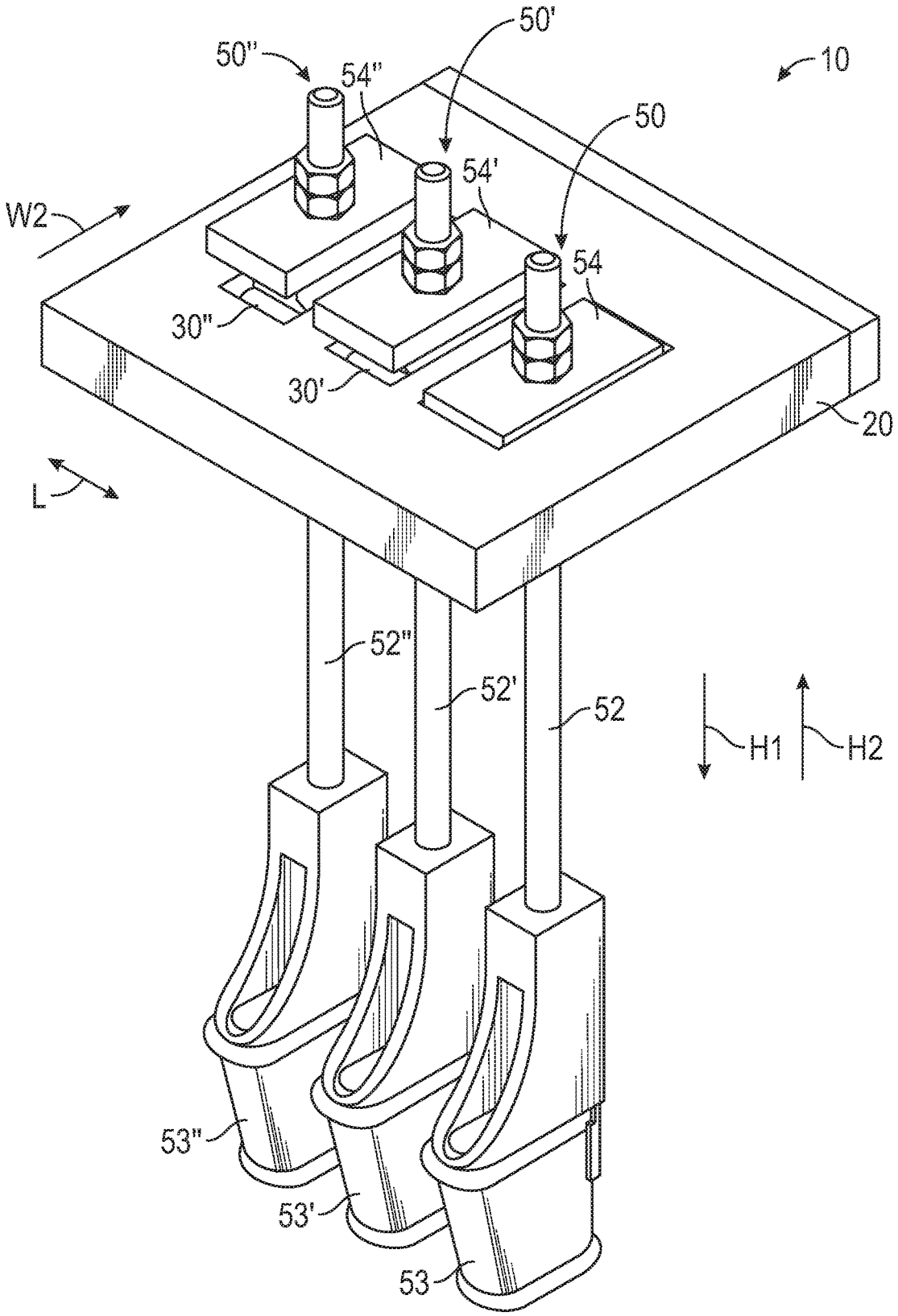
FIG. 8 is a perspective view of the automatic rope tension equalizing system in use.

For example, FIGS. 7 and 8 illustrate a situation in which the rope 12 is over-tensioned and at least one of ropes 12', 12" is accordingly under-tensioned. Tension on the rope 12 is transferred to the rod 52 and the cam 56, moving the cam in direction H1. And as the cam 56 moves in direction H1, interaction between the cam face 56*a* and the plunger 40 forces the plunger 40 further into the cavity 23. Movement of the plunger 40 further into the cavity 23 displaces the fluid in the network 60, causing the plungers 12', 12" at the under-tensioned state to further exit the respective cavities 23', 23". That movement of the plungers 12', 12" causes (through interaction between the plungers 12', 12" and the cams 56', 56") the rods 52', 52" to move in direction H2, increasing tension on the ropes 12', 12". It should be appreciated that not all of the plungers 40, 40', 40" will be at identical locations within the respective cavities 23, 23', 23" when at the equalized state, and that not all of the cam assemblies 50, 50', 50" will be at identical heights relative to the hitch plate 20 when at the equalized state. Moreover, the arrangement shown in FIGS. 7 and 8 may illustrate an equalized state.

Figure 9:
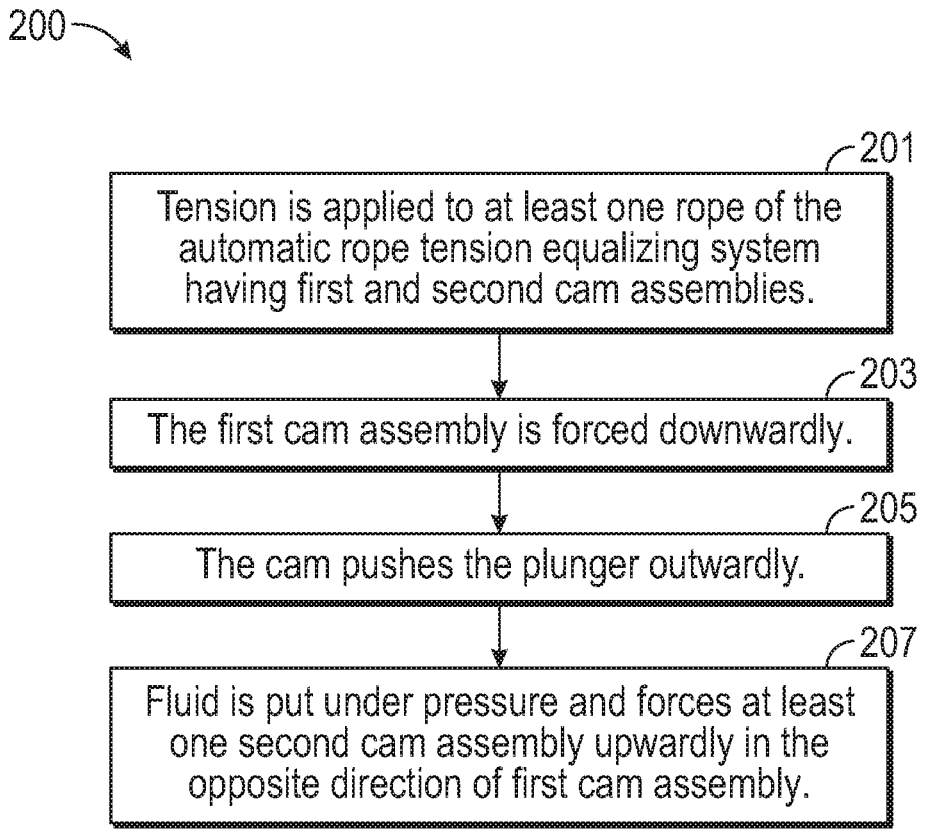
FIG. 9 is a flow chart of a method for automatically equalizing rope tension utilizing the automatic rope tension equalizing system.

FIG. 9 shows a method 200 of automatically equalizing the tension of the ropes 12, 12', 12". In step 201, tension is applied to at least one of the ropes 12, 12', 12" of the automatic rope tension equalizing system 10. In step 203, the cam assembly 50, 50', 50" associated with the rope 12, 12', 12" receiving the tension is forced in direction H1 (downwardly). In step 205, the associated cam 56, 56', 56" pushes the relevant plunger 40, 40', 40" in direction W2 (outwardly). In step 207, fluid in the network 60 is displaced by the relevant plunger 40, 40', 40", forcing at least one other cam assembly 50, 50', 50" in direction H2 (upwardly) due to interaction between the associated plunger 40, 40', 40" and the associated cam 56, 56', 56".

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure. Further, it will be understood that certain features and subcombinations may be of utility and may be employed within the scope of the disclosure. Further, various steps set forth herein may be carried out in orders that differ from those set forth herein without departing from the scope of the present methods. This description shall not be restricted to the above embodiments.

It is to be understood that while certain forms of the present disclosure have been illustrated and described herein, it is not to be limited to the specific forms or arrangement of parts described and shown.

The invention claimed is:

1. An automatic tension equalizer system, comprising:

a hitch plate having first and second apertures, each said aperture having a cavity;

a first plunger at least partially situated in said cavity of said first aperture;

a second plunger at least partially situated in said cavity of said second aperture;

first and second cam assemblies respectively positioned at least partially within said first and second apertures, each said cam assembly having a cam and a rod extending therefrom, said cam of said first cam assembly engaging said first plunger, said cam of said second cam assembly engaging said second plunger;

a network connecting each said cavity to each other said cavity; and fluid in said network automatically equalizing pressure on said first and second plungers, thereby affecting positioning of said first and second plungers and, through each said cam, tension on each said rod, wherein excess tension on said rod of said first cam assembly causes, via interaction between said cam of said first cam assembly and said first plunger, said first plunger to further enter said cavity of said first aperture.

2. The automatic tension equalizer system of claim 1, wherein said fluid is at least one item selected from the group consisting of: a hydraulic fluid and a pneumatic gas.

3. The automatic tension equalizer system of claim 1, wherein each said plunger has a rotational interfacing member contacting a respective said cam.

4. The automatic tension equalizer system of claim 3, wherein said rotational interfacing member of said first plunger rotates about a single axis.

5. The automatic tension equalizer system of claim 1, wherein each said rod is permanently attached to a suspension means.

6. The automatic tension equalizer system of claim 1, wherein each said suspension means comprises at least one item selected from the group consisting of a rope and a belt.

7. The automatic tension equalizer system of claim 1, wherein said first plunger further entering said cavity of said first aperture displaces said fluid in said network, causing said second plunger to further exit said cavity of said second aperture, thereby causing, via interaction between said cam of said second cam assembly and said second plunger, tension to increase on said rod of said second cam assembly.

8. The automatic tension equalizer system of claim 1, wherein said cam of said first cam assembly is adjacent a cam retainer plate, said rod of said first cam assembly passing through a hole in said cam retainer plate.

9. The automatic tension equalizer system of claim 1, wherein said rod of said first cam assembly has a first coupling member engaging a first suspension means, and wherein said rod of said second cam assembly has a second coupling member engaging a second suspension means.

10. The automatic tension equalizer system of claim 9, wherein said first and second suspension means support an elevator car.

11. The automatic tension equalizer system of claim 1, wherein:

said cam of said first cam assembly has a face engaging said first plunger; and said face has a shape selected from the group consisting of: conical, planar, concave, and convex.

12. The automatic tension equalizer system of claim 1, wherein said rod of said first cam assembly extends perpendicularly to a direction of travel of said first plunger.

13. The automatic tension equalizer system of claim 1, wherein:

said hitch plate further comprises a third aperture, said third aperture having a cavity, a third plunger at least partially situated in said cavity of said third aperture;

a third cam assembly positioned at least partially within said third aperture, said third cam assembly having a cam and a rod extending therefrom, said cam of said third cam assembly engaging said third plunger; and fluid in said network automatically equalizes pressure on said first, second, and third plungers, thereby affecting positioning of said first, second, and third plungers and, through each said cam, tension on each said rod.

14. The automatic tension equalizer system of claim 1, further comprising a roller, said cam of said first cam assembly being positioned between said roller and said first plunger.

15. An automatic tension equalizer system, comprising:

a hitch plate having a first cavity, a second cavity, and a third cavity;

a first plunger at least partially situated in said first cavity;

a second plunger at least partially situated in said second cavity;

a third plunger at least partially situated in said third cavity;

first, second, and third cam assemblies, each said cam assembly comprising, a cam, and a rod extending from said cam, which rod includes a coupling member, said cam of said first cam assembly engaging said first plunger, said cam of said second cam assembly engaging said second plunger, said cam of said third cam assembly engaging said third plunger, said coupling member of said first cam assembly engaging a first suspension means of an elevator car, said coupling member of said second cam assembly engaging a second suspension means, and said coupling member of said third cam assembly engaging a third suspension means, each of said first, second, and third suspension means supporting an elevator car;

a network connecting each said cavity to each other said cavity; and fluid in said network automatically equalizing pressure on said first, second, and third plungers, thereby affecting positioning of said first, second, and third plungers and, through each said cam, tension on each said rod.

16. The automatic tension equalizer system of claim 15, wherein:

excess tension on said rod of said first cam assembly causes, via interaction between said cam of said first cam assembly and said first plunger, said first plunger to further enter said first cavity;

said first plunger further entering said first cavity displaces said fluid in said network, causing:

said second plunger to further exit said second cavity, thereby causing, via interaction between said cam of said second cam assembly and said second plunger, tension to increase on said rod of said second cam assembly; and said third plunger to further exit said third cavity, thereby causing, via interaction between said cam of said third cam assembly and said third plunger, tension to increase on said rod of said third cam assembly.

17. An elevator system, comprising:

an elevator car;

a first suspension means supporting said elevator car;

a second suspension means supporting said elevator car;

a hitch plate having a first cavity and a second cavity;

a first plunger at least partially situated in said first cavity;

a second plunger at least partially situated in said second cavity;

first and second cam assemblies, each said cam assembly having a cam and a rod extending therefrom, said cam of said first cam assembly engaging said first plunger, said cam of said second cam assembly engaging said second plunger, said rod of said first cam assembly having a first coupling member engaging said first suspension means, said rod of said second cam assembly having a second coupling member engaging said second suspension means;

a network connecting each said cavity to each other said cavity; and fluid in said network automatically equalizing pressure on said first and second plungers, thereby affecting positioning of said first and second plungers and, through each said cam, tension on each said rod.

18. The elevator system of claim 17, wherein:

excess tension on said rod of said first cam assembly causes, via interaction between said cam of said first cam assembly and said first plunger, said first plunger to further enter said first cavity;

excess tension on said rod of said second cam assembly causes, via interaction between said cam of said second cam assembly and said second plunger, said second plunger to further enter said second cavity;

said first plunger further entering said first cavity displaces said fluid in said network, causing said second plunger to further exit said second cavity, thereby causing, via interaction between said cam of said second cam assembly and said second plunger, tension to increase on said rod of said second cam assembly; and said second plunger further entering said second cavity displaces said fluid in said network, causing said first plunger to further exit said first cavity, thereby causing, via interaction between said cam of said first cam assembly and said first plunger, tension to increase on said rod of said first cam assembly.

* * * * *